United States Patent [19]

Cox

[11] Patent Number: 4,553,484

[45] **Date of Patent: * Nov. 19, 1985**

[54] CORNERBOARD FOR PALLETS

[76] Inventor: Clayton E. Cox, 1181 San Andreas Rd., Watsonville, Calif. 95076

[ * ] Notice: The portion of the term of this patent subsequent to May 5, 1998 has been disclaimed.

[21] Appl. No.: 429,062

[22] Filed: Sep. 30, 1982

[51] Int. Cl.[4] ..... B65D 19/14

[52] U.S. Cl. ..... 108/55.1; 403/353

[58] Field of Search ..... 403/406, 353; 108/53.1, 108/55.1

[56] References Cited

U.S. PATENT DOCUMENTS

| | | | |
|---|---|---|---|
| 1,804,420 | 5/1931 | Kelley | 403/353 X |
| 3,813,735 | 6/1974 | Thiermann | 403/353 X |
| 4,265,184 | 5/1981 | Cox | 108/55.1 |

*Primary Examiner*—Andrew V. Kundrat

[57] ABSTRACT

An improved cornerboard for a pallet is provided wherein the main portion consists of two L-shaped metal sections with complementary pins and slots so that the cornerboard height can be readily adjusted. The cornerboard is easily fabricated from steel sheet sections utilizing conventional bending, stamping, riveting and welding techniques.

1 Claim, 4 Drawing Figures

CORNERBOARD FOR PALLETS

REFERENCE TO RELATED PATENT

The present invention is an improvement on my prior U.S. Pat. No. 4,265,184 issued May 5, 1981.

SUMMARY OF THE INVENTION

Many materials, such as frozen foods, are sold in relatively small cartons and in order to handle these expeditiously, they are placed on pallets. In order that the pallets can be handled and stored it is ordinarily necessary to provide some sort of corner structure for the palleted goods to keep the goods upright and to prevent them for sliding off the pallets.

In accordance with the present invention, an improved corner structure is provided for pallets which is fabricated from steel sheets and rivets yielding a strong, yet inexpensive structure.

The cornerboards are fabricated of two main parts, each of which is L-shaped, having a complementary pin and slot configuration so that the height of the cornerboard can easily be adjusted to suit a given load and will provide a strong load-bearing corner for the pallet load.

Preferably, the cornerboards are provided with top and bottom caps so that when a plurality of pallets are stacked together, the cornerboards support substantially all of the weight of the stacked pallets so that there is no tendency to crush the goods.

The cornerboard structure of the present invention can be easily fabricated from steel sheets and special rivets utilizing conventional bending, stamping, riveting and welding techniques.

Another feature of the present invention is that one or more slots are omitted on one side of the L at the top. This prevents a user from extending the cornerboard to an extended position which would render it unsafe.

Other features and advantages of the invention will be brought out in the balance of the application.

DESCRIPTION OF THE PREFERRED EMBODIMENTS

Figure 1:
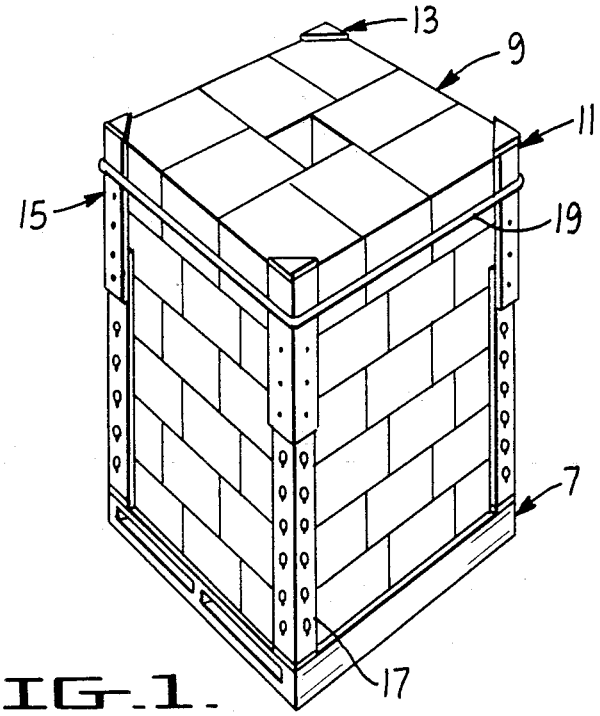
FIG. 1 is a perspective view of a loaded pallet utilizing corner structures embodying the present invention.

Referring now to the drawings by reference characters, there is shown a pallet 7 having a load of boxes 9 thereon. The boxes 9 have a rectangular configuration and have been stacked to fit the pallet 7.

In accordance with the present invention, four corner elements, generally designated 11, 13, 15, and 17, are placed at the four corners of the loaded pallet and a flexible strap 19 is employed to hold the cornerboards together and maintain the pallet load in a desired configuration. Although only a single strap 19 has been shown, in many instances two or even more straps might be used around the load.

Figure 3:
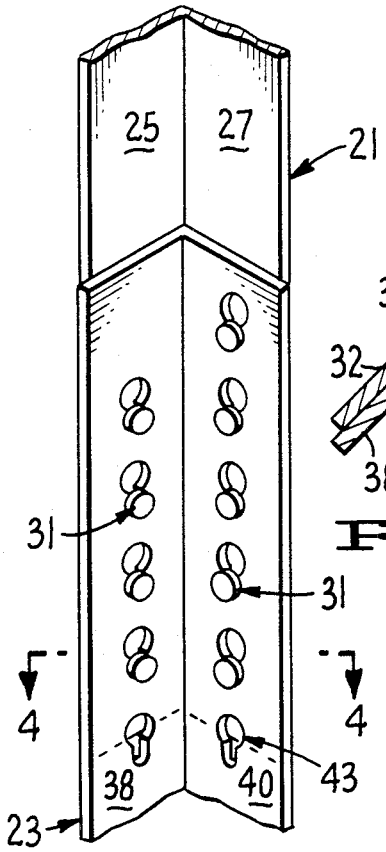
FIG. 3 is a partial perspective view of the structure of FIG. 2 in assembled condition.
Figure 4:
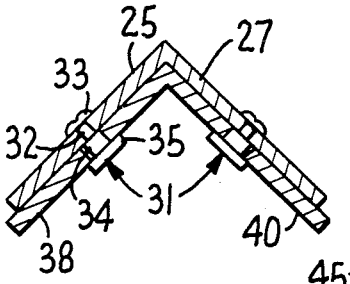
FIG. 4 is a section on line 4—4 of FIG. 3.
Figure 2:
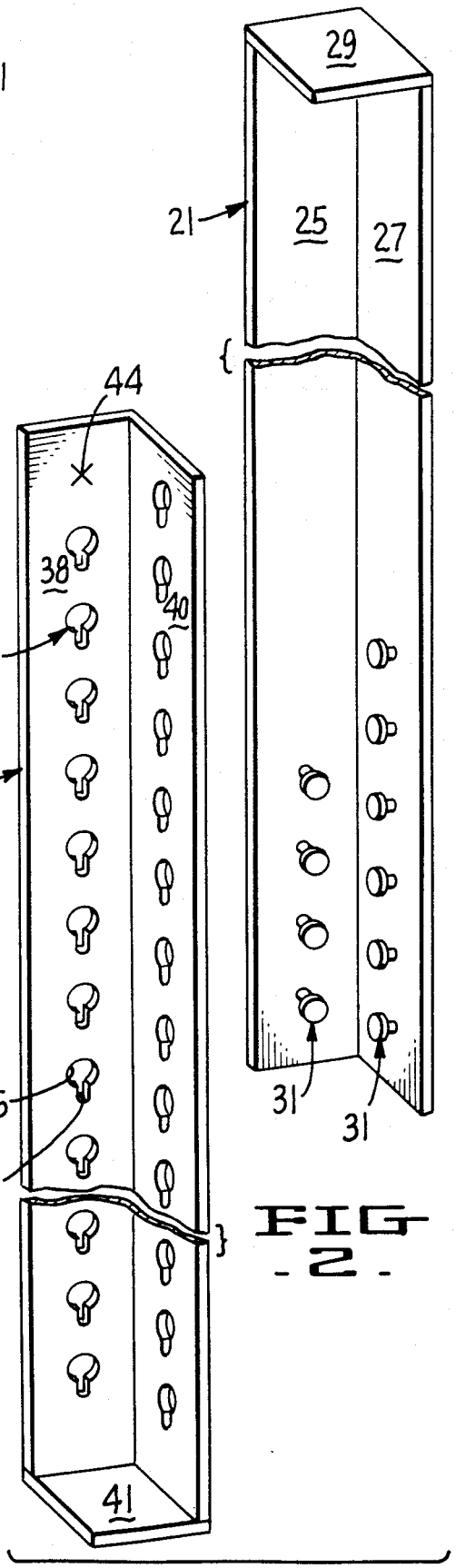
FIG. 2 is an exploded, enlarged perspective view of a cornerboard embodying the present invention.

Since each of the cornerboards is identical, only one will be described in detail. Referring specifically to FIGS. 2 through 4, each of the cornerboards consists of an upper section, generally designated 21, and a lower section, generally designated 23. The upper section is formed, preferably by bending, of a steel sheet so that one has the walls 25 and 27 held at substantially right angles to each other. Preferably, a top cap 29 is provided which may be stamped of steel and welded onto the upper section 21. Each of the walls 25 and 27 has a series of pins, generally designated 31, spaced at regular intervals along the wall. Each of the pins consists of a shaft 32 with a head 33 on the outside of a wall 25 or 27 and a shoulder 34 on the inside of the wall. Thus the pin is held securely in place by the head 33 and shoulder 34. Beyond the shoulder 4 is an elongated cap 35. The height of the shoulder is just slightly greater than that of the thickness of the walls 37 and 39.

The bottom section 23 is of the same general configuration, having the walls 38 and 40 and a bottom plate 41 of the same general configuration as the top plate 29. The bottom section 23 is provided with a plurality of holes 43, corresponding in placement and separation to the pins 31 except that there is no hole on one side at the point marked with an "X" and designated 44. This is a safety feature which prevents a user from locking the two parts together at the extreme top of 41 which would create an unstable, dangerous condition. Thus at least three pins will be locked at all times. Of course, more holes or one or both sides might be omitted if it is desired that a greater number of pins be locked when the structure is fully extended and one or more pins can be omitted. Each of the holes 43 consists of an enlarged upper round portion 45, corresponding in size to a cap 35, and a smaller lower portion 47, corresponding in size to a shoulder 34.

In use, it is only necessary to place the two sections in proximity to each other and to bring the upper section into contact with the lower so that the pins 31 extend through the holes 43. Now, if one pushes downwardly slightly on the upper member, the pins will lock into place on the bottom section as is clearly shown in FIG. 3 of the drawings.

In the foregoing description, it has been assumed that the upper and lower sections would be fabricated in such a way that a considerable range of adjustment would be possible. In some instances, the cornerboards might be fabricated to fit a certain specific load in which case the large range of adjustment would not be necessary. In fact, in its simplest form, the top member might have only a few pairs of pins set at right angles thereto while the bottom section might have only a few pairs of mating slots for the reception of the pins. However, it is preferred that a plurality of pins be formed between each of the metal sections, both from the standpoint of increased strength when more than one set of tongues is used to lock the structure and also because of the desirability of providing the adjustable feature.

Many variations can be made in the exact structure shown without departing from the spirit of this invention.

I claim:

1. A corner structure for a pallet comprising in combination:

(a) a top section, said top section having two side walls disposed at right angles to each other, forming an L-shaped structure;

(b) a top cap bridging the top walls of said L-shaped structure;

(c) a plurality of pins directed inwardly from each side wall of said top section, each of said pins terminating in a shoulder with an enlarged cap thereon;

(d) a bottom section of the same general configuration as said top section having side walls at right angles to each other and a bottom cap bridging the lower surfaces of said side walls;

(e) said lower section having a plurality of holes formed in each side wall corresponding in placement and separation to the pins in the top section each hole comprising a large top portion corresponding in diameter to a cap and a smaller lower portion corresponding in size to a shoulder whereby said top and bottom sections can be locked together to form a pallet corner, with said pins entering said slots and locking against the side walls of the bottom section, (f) said top section and said bottom section have a plurality of pins and holes in the respective sections, spaced vertically from each other whereby said sections can be locked together at various preselected heights to change the distance between said top and bottom caps and (g) said lower section having at least one hole missing at the top thereof whereby at least three pins must always be in locking position for the sections to lock together.

* * * * *